United States Patent [19]

Karinthi et al.

[11] Patent Number: 4,607,488

[45] Date of Patent: Aug. 26, 1986

[54] GROUND CONGELATION PROCESS AND INSTALLATION

[75] Inventors: Pierre Karinthi, Jouy-en-Josas; Maurice Gardent, Herbeys; Colette Régniér, Echirolles; Jean Tuccella, Grenoble, all of France

[73] Assignee: L'Air Liquide, Societe Anonyme Pour l'Etude et l'Exploitation des Procedes Georges Claude, Paris, France

[21] Appl. No.: 738,384

[22] Filed: May 28, 1985

[30] Foreign Application Priority Data

Jun. 1, 1984 [FR] France ..... 84 08646

[51] Int. Cl.[4] ..... F17C 1/00

[52] U.S. Cl. ..... 62/45; 62/62; 62/260; 62/514 R; 165/45

[58] Field of Search ..... 62/45, 260, 62, 514 R; 165/45

[56] References Cited

U.S. PATENT DOCUMENTS

| | | | |
|---|---|---|---|
| 3,183,675 | 5/1965 | Schroeder | 62/260 |
| 3,287,915 | 11/1966 | Massey | 62/260 |
| 3,674,086 | 7/1972 | Foster | 62/260 |
| 3,701,262 | 10/1972 | Connell et al. | 62/45 |

FOREIGN PATENT DOCUMENTS

| | | |
|---|---|---|
| 2614221 | 10/1977 | Fed. Rep. of Germany . |
| 1327179 | 4/1963 | France . |
| 2113980 | 6/1972 | France . |
| 2452550 | 10/1980 | France . |

*Primary Examiner*—Ronald C. Capossela

*Attorney, Agent, or Firm*—Young & Thompson

[57] ABSTRACT

A refrigerant liquid flows through congelation probes (S1, S2, . . . ). The temperature of the liquid supplied to each probe is regulated as a function of the rate of congelation of the ground around the various probes and/or is progressively increased as the congelation progresses.

14 Claims, 4 Drawing Figures

GROUND CONGELATION PROCESS AND INSTALLATION

The present invention relates to the technique of congelation of grounds. It concerns first of all a process for the congelation of ground of the type in which a refrigerant liquid is cooled by the exchange of heat with a cryogenic fluid and then this liquid is made to flow in a series of probes driven into the ground.

It is known that the consolidation of grounds by congelation permits the opening up of public works sites in damp and unstable grounds. It is carried out by the injection of a refrigerant fluid into probes inserted in different places in the ground. This cooling congeals the ground progressively until a continuous wall is formed when the congelation regions of each probe have joined up with neighbouring regions.

It is known to inject into the probes either a cooled liquid or a cryogenic liquid such as liquid nitrogen.

The direct injection of liquid nitrogen presents several drawbacks, and in particular the difficulty of controlling the coefficients of thermal exchange with the ground: in giving up cold the nitrogen is vaporized and the coefficients of exchange between the probe and the pure liquid nitrogen first of all, then the mixtures of liquid and gas in a variable proportion, and then the cold gas alone, are very different. There is consequently a high heterogeneity in the thickness of the congealed ground around the probe and a loss of time and energy in allowing the least congealed regions to join up to form the consolidated wall, while the most congealed regions are unnecessarily super-cooled and over-sized.

The injection of a cooled liquid does not have these drawbacks, but its efficiency depends on the cooling method.

The cooling of a liquid flowing through a refrigerating unit permits the injection of the liquid at −40° C. in best cases and more usually at −20° C. or −30° C. These congelation conditions result in a prohibitive period for forming the wall, namely on the order of several weeks in respect of a wall having a thickness of 1 m.

This period is usually incompatible with the duration of the sites in towns.

In order to be able to circulate in the probes a liquid at a much lower temperature, for example −80° C. or even −120° C., congelation processes of the aforementioned type have also been proposed.

Such a process permits the solving of the aforementioned drawbacks but at the present time remains costly for the following reasons: on one hand, in order to accelerate the congelation, it is necessary to cool the ground more than is strictly necessary for its consolidation. On the other hand, the ground is always hetergeneous and the consolidation of the congealed wall is governed by the weakest point, i.e. where the congelation advances at the slowest rate. It is then necessary to extend, sometimes in considerable proportions, the most rapidly congealed regions.

An object of dimension is to considerably reduce the excess of cold and consequently to render the process much more economical without substantially increasing the duration of the congelation.

The invention consequently provides a process for the congelation of the ground of the aforementioned type, wherein the temperature of the refrigerant liquid is varied, in the course of the ground congelation stage, as a function of the progression of the congelation.

In a first manner of carrying out the invention, the temperature of the liquid flowing in at least one of the probes is progressively increased, preferably in successive stages.

In a second manner of carrying out the invention, which may be combined with the first, the temperature of the liquid flowing in each probe is adapted to the rate of congelation of the ground around this probe, this temperature being regulated to a value which is the higher as the rate of congelation is higher.

Another object of invention is to provide an installation for the congelation of the ground adapted to carry out said process. This installation, of the type comprising a heat exchanger supplied with, n the one hand, cryogenic fluid and, on the other hand, a refrigerant liquid, a series of congelation probes, and means for circulating the liquid in each probe, is characterized in that it comprises means for varying the set temperature of the heat exchanger, and/or that it comprises at least two independent heat exchangers having different set temperatures.

A few examples of carrying out the invention will now be described with reference to the accompanying drawings, in which.

In each of the following embodiments, the invention concerns the formation in a sandy and damp ground of a congealed wall in the shelter of which certain works can be carried out. For this purpose, there are driven into the ground a series of congelation probes S1, S2 . . . , diagrammatically illustrated in FIG. 3 and there is circulated in each of the probes a refrigerant liquid having a given inlet temperature. The chosen liquid must have a sufficiently low congelation point, and methanol is a suitable liquid to which reference will be made hereinafter.

Figure 3:
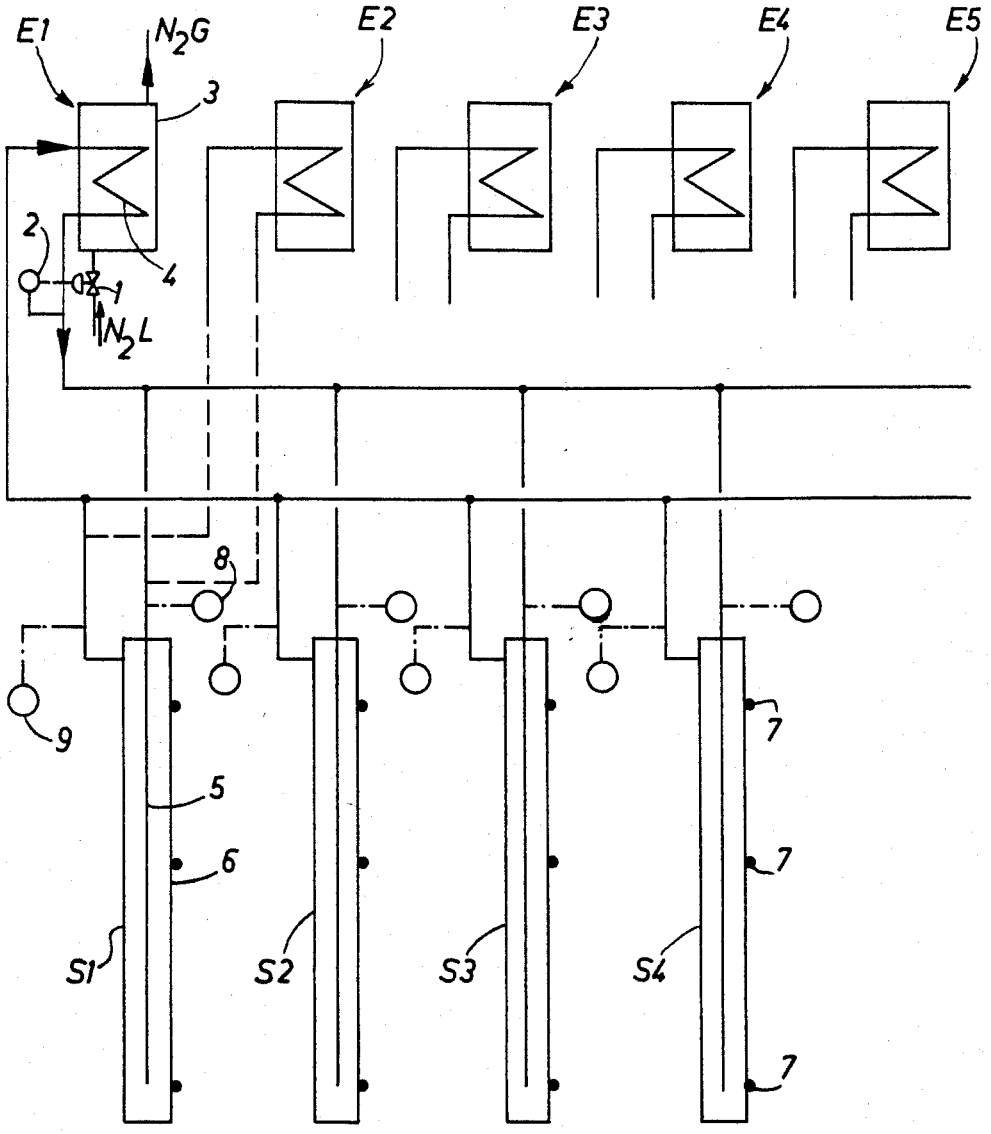
FIG. 3 is a diagram of an installation corresponding to a second manner of carrying out the invention.

As shown in FIG. 3 this liquid flows in a closed circuit between the probe and heat exchanger E1, E2, . . . , termed a "cold station" which comprises, on one hand, passages for this liquid and, on the other hand, passages for a cryogenic fluid, in particular liquid nitrogen. The rate of supply of liquid nitrogen to these last-mentioned passages is controlled by a valve 1 controlled by a temperature sensor 2 which detects the temperature of the refrigerant liquid issuing from the exchanger. The nitrogen passages may for example, as illustrated in FIG. 3, be formed by a heat exchanger 3 through which extends a coiled tube 4 for the circulation of the refrigerant liquid in countercurrent manner with respect to the nitrogen. These elements have been shown in FIG. 3 only for the exchanger E1 in order to render the drawings more clear, but it will be understood that if the installation has a plurality of exchangers, as that shown in FIG. 3, all these exchangers have a similar construction.

Refrigerant liquid issuing at a set cold temperature from an exchanger is injected at the bottom of each probe, connected to the latter, through a central tube 5 of the probe and rises between the tube and the cylindrical case 6 of the probe and returns to the exchanger.

Between the probe inlet and outlet, the liquid exchanges heat with the surrounding ground through the case 6.

Figure 1:
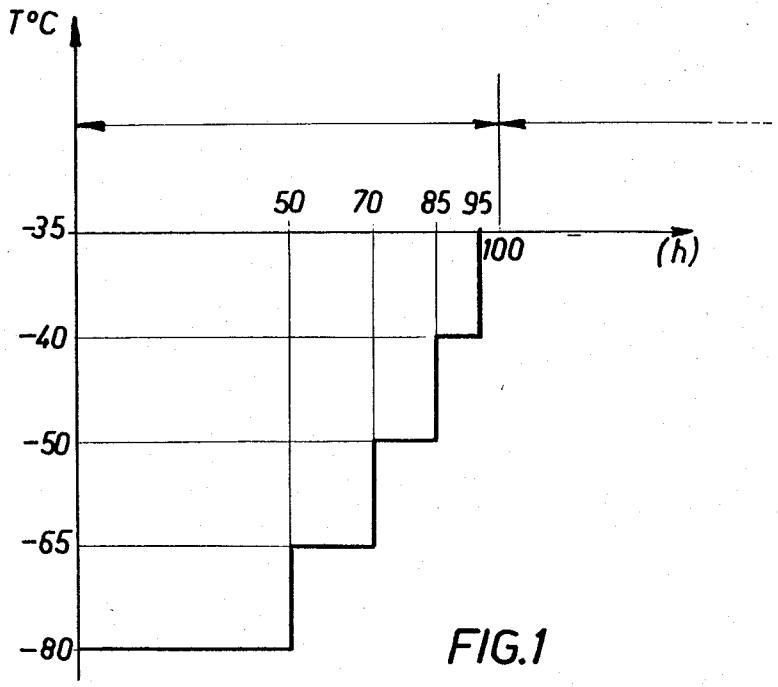
FIG. 1 is a diagram illustrating a first manner of carrying out the invention.

In the manner of carrying out the invention illustrated in FIG. 1, the temperature of the refrigerant liquid injected into the congelation probes is modified with respect to time by progressively increasing this temperature from a minimum temperature of the start of the congelation to a final temperature for maintaining the already-congealed wall cold. In the illustrated example, this increase occurs in successive stages.

EXAMPLE I

As a numerical example, it will be assumed that it is desired to consolidate by congelation within 100 hours a wall having a thickness of 1 meter in a damp and sandy ground, to a depth of 20 meters and to a length of 50 meters. For this purpose, fifty probes S1, S2, . . . , S50 spaced apart 1 meter from one another are driven into the ground. Methanol is circulated between the probes, connected in parallel, and a single heat exchanger cooled by liquid nitrogen, such as the exchanger E1 described hereinbefore. The temperature sensor 2 is provided with a regulating device for the purpose of regulating as desired the temperature of the methanol between −80° C. (which is the lower limit allowed for this body) and −10° C.

The congelation is started by circulating the methanol with a set temperature at the outlet of the exchanger (and therefore at the injection into the probes) of −80° C. This set temperature is maintained for 50 hours. The temperature of the ground in the vicinity of the probes is then established at −70° C. and the congealed radius around the probes is 38 cm (namely a diameter of 76 cm).

At this moment, the set temperature of the methanol is regulated to −65° C. This temperature is maintained for 20 hours. The temperature of the ground in the vicinity of the probes is established at −57° C. During this period of time, the progression of the front of the congelation of the wall has practically not slowed down, since it is governed by the temperature gradient in the vicinity of the congelation isotherm (0° C.) and not by the temperature of the probe. There is thus obtained at the end of 70 hours of congelation a congealed diameter of 84 cm.

After 70 hours of congelation, the set temperature of the methanol is fixed at −50° C. This set temperature is maintained for 15 hours. Temperature of the ground in the vicinity of the probes is established at −44° C. At the end of 85 hours, the congealed diameter around the probes is 88 cm.

The temperature of methanol is then set at −40° C. It is maintained for 10 hours. The temperature of the ground in the vicinity of the probes is established at −35° C. At the end of 95 hours of congelation, the diameter of the congealed ground around the probes is 90 cm.

The set temperature of the methanol is then established at −35° C. This set temperature will be maintained for the whole of the period of maintenance of the congealed wall. The temperature of the ground around the probes will reach an equilibrium at −30° C. A congelation having a diameter of 100 cm will be obtained at the end of about 100 hours.

Note that the foregoing indications correspond to a homogeneous ground and to an isolated probe; in fact, each congelation probe reacts with its neighbouring probes which results, for a spacing of 1 meter between the probes, in a congealed wall having a variable thickness: 1 meter in the region of the probes, and about 80 cm half-way between the probes.

It will moreover be understood that, by way of a modification, the different set temperatures of the methanol may be obtained not by means of a single exchanger having an adjustable set temperature, but by means of a plurality of heat exchangers having different but fixed set temperatures, it being possible to selectively connect these exchangers to the probes through an appropriate set of valves. Further, if the available exchangers do not permit providing individually the required refrigerating power (proportional to the product of the rate of flow of methanol by the temperature difference between the inlet and the outlet of the exchanger), there may be used for each set temperature a plurality of exchangers connected in parallel and set to the same temperature.

Figure 2:
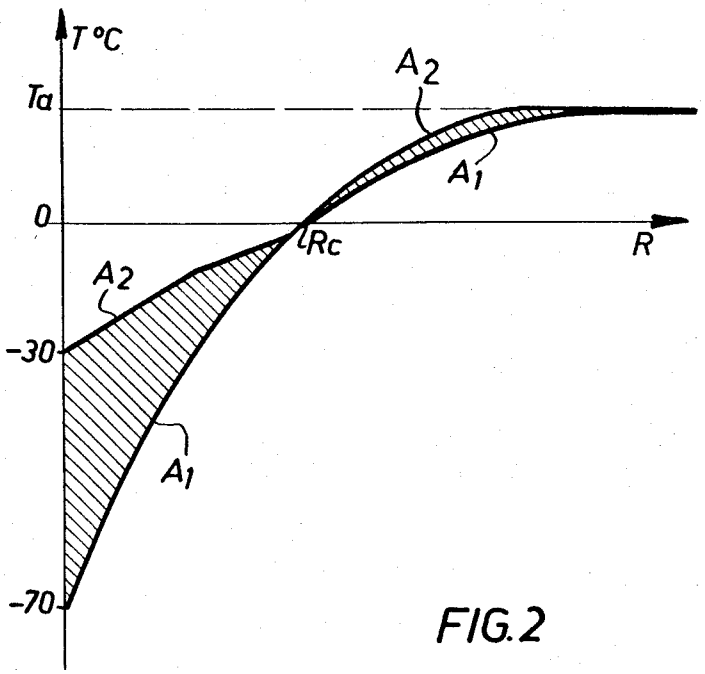
FIG. 2 is a diagram illustrating the advantage afforded by the process illustrated in FIG. 1.

FIG. 2 illustrates the advantage of the process described hereinbefore. It represents the variation of the temperature T of the ground as a function of the radius R measured from the outer wall of a probe assumed to be isolated, at the end of the congelation, i.e. when the congealed radius Rc becomes in the neighbourhood of the semi-distance between the probes (about 0.5 m in the foregoing example).

The lower curve A1 corresponds to the case where the probe would have been permanently supplied with methanol at −80° C. in accordance with the prior art. This curve rises from −70° C. for R=0 to 0° C. for R=Rc, then from 0° C. to the ambient temperature Ta. The upper curve A2 corresponds to the method according to the invention described hereinbefore; it rises from −30° C. for R=0 to 0° C. for R=Rc, then continues to rise from 0° C. to Ta while remaining above the curve A1. The crosshatched area between the two curves A1 and A2 represents the economy of negative calories achieved.

In the embodiment shown in FIG. 3, the temperature of the methanol is regulated not with respect to time but with respect to space by adapting this temperature for each probe to the rate of congelation of the ground around this probe so as to avoid excessively supercooling the parts of the ground which congeal the quickest. Indeed, in actual fact, if a ground is generally relatively homogeneous within the radius of 50 to 60 cm around a probe, this is not true from one probe to another.

For this purpose, a plurality of heat exchangers E1, E2, . . . , namely, five exchangers in the illustrated embodiment, are used, these exchangers having set temperatures which are independently adjustable and each being capable of connection to all of the probes. The rate of cooling of the ground is measured at the start of the congelation and methanol is sent into each probe at a temperature which is all the less cold as the ground concerned by this probe is cooled more rapidly.

The congelation rate which will enable a set temperature to be fixed for each probe and each heat exchanger can be determined for example in the following manner.

There may first of all be effected overall measurements of the cooling for each probe:

(a) The measurement of the difference of temperature between the inlet and the outlet of the methanol in each probe is a measurement which is characteristic of the heat flux absorbed by the ground for a given rate of flow. If this temperature is higher for a particular probe, the temperature of injection of the methanol into this probe must be raised, since the ground absorbs much cold.

Figure 4:
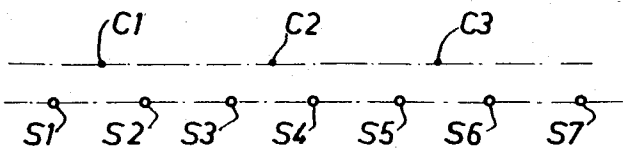
FIG. 4 illustrates diagrammatically a modification.

(b) There may also be disposed parallel to the line of probes a line of temperature sensors C1, C2 , . . . , for example as shown in FIG. 4 where a temperature sensor is disposed in the ground close to the surface between the pairs of successive probes at equal distance from the two probes of each pair. In the same way as before, the temperature of the injection of the methanol into the probes the closest to these sensors is then fixed as a function of the rate of cooling of the ground shown thereby.

However, in practice, it often occurs that, on the length of the wall to be congealed, the ground is heterogeneous not only horizontally but also vertically, at least in certain regions. There may therefore exist, in the height of certain probes regions which congeal rapidly and others which congeal slowly. Consequently, the overall measuring means mentioned hereinbefore would be liable to excessively slow down the cooling of a probe which would on the whole congeal rapidly (which would for example appear from a large difference of temperature between the entering methanol and the leaving methanol) but, in fact very rapidly in a portion of its length and very slowly in another portion.

In order to avoid this risk, the measurement may be refined by disposing a plurality of temperature sensors 7 on the length of the probes, on their outer wall, these sensors being adapted to measure the temperature of the ground in the immediate vicinity of the probes. One can then proceed in two manners:

(c) At the beginning of the cooling, the rate of cooling at each of these points is measured, or (d) A certain time after the beginning of the congelation, there is temporarily injected, for example for 10 to 30 minutes, methanol which is warmer than the ground, and there is measured the rate of elevation of the temperature at the different measuring points. Indeed, this rate of elevation varies in the same direction as the rate of congelation of the ground.

If this procedure permits a detection of a vertical heterogeneity of the ground, the determination of the temperature of injection of the methanol into the corresponding probe or probes will be based on the smallest temperature variation.

EXAMPLE II

The following example illustrates the manner of carrying out the invention with the methods (a) and (d) mentioned hereinbefore. The basic data are the same as before. It is desired to congeal within 100 hours a wall having a thickness of 1 meter in a damp and sandy ground, to a depth of 20 meters and length of 50 meters. There are disposed in the ground fifty probes S1, S2 , . . . , S50 spaced 1 meter apart, and cooled methanol is circulated therethrough. Five heat exchangers E1 to E5 are employed which are independent and supplied with liquid nitrogen in accordance with the diagram of FIG. 3. By means of an appropriate set of pipes and valves (not shown), it is possible to feed any probe from any exchanger. Each probe is provided with temperature sensors 8 and 9 measuring the temperature of the methanol at its entrance and its exit respectively. Thermocouples 7 are disposed against the outer wall of each probe for the purpose of measuring the temperature at a depth of 2 meters, 10 meters, and 18 meters.

After the starting of the injection of methanol at −80° C. into all of the probes, there is a pause of 5 hours in order to allow the initial transitional effects to take place. There is observed at that moment on the probes the following temperature difference ΔT between the entrance and the exit of the methanol.

| probes N° | 1 to 4 | 5 to 12 | 13, 14 | 15 to 25 | 26 to 40 | 41 to 50 |
|---|---|---|---|---|---|---|
| T °C. | 10 | 4 | 6 | 4 | 6 | 8 |

The temperature of the outer surface of the probes is but slightly variable at this moment between −70° C. and −72° C. for all the probes.

By changing the set temperature of the exchangers E1 to E5, methanol at −50° C. is injected into the probes for 20 minutes. The rate of the rise in the external temperatures of the probes is measured. There is found at 18 meters depth on the probes S46 to S50 a rate of rise in temperature which is one third of those at depths of 10 meters and 2 meters on the same probes; no heterogeneity is found on the other probes.

The injection of cold methanol is then re-established by fixing the set temperatures in the following manner.

| probes N° | 1 to 4 | 5 to 12 | 13, 14 | 15 to 25 | 26 to 40 | 41 to 45 | 46 to 50 |
|---|---|---|---|---|---|---|---|
| temperature (°C.) | −55 | −80 | −70 | −80 | −70 | −55 | −80 |
| Exchangers | E1 | E2 & E3 | E4 & E5 | E2 & E3 | E4 & E5 | E1 | E2 & E3 |

As can be seen, notwithstanding the results of the overall measurement, the probes S46 to S50 have been treated as probes having a slow congelation so as to take into account the slowness in the congelation observed in their deepest part.

Further, certain groups of probes are supplied by two exchangers connected in parallel. This provides a rate of flow of methanol on the same order for all the probes. Note also that, in order to avoid rendering the installation too complicated, the groups of probes S1 to S4 and S41 to S45 are supplied at the same temperature although, to be exact, the probes of these two groups absorb different heat fluxes.

It is clear from the foregoing that a refrigerating power is supplied to each probe which decreases as the ground surrounding this probe congeals more rapidly.

EXAMPLE III

The following example illustrates the aforementioned procedure (b).

With the same basic data as in the preceding examples, there is disposed at 40 cm from the line of congelation probes a line of twenty-five temperature sensors C1, C2, . . . , C25 in the region of every other gap between the congelation probes, as indicated in FIG. 4, each sensor being located at an equal distance from 2 probes. The temperature sensor C1 is in the vicinity of the congelation probes S1 and S2, the temperature sensor C2 is in the vicinity of the congelation probes S3 and S4, etc.

Methanol at −80° C. is first of all injected into all of the congelation probes for 24 hours. At the end of 24 hours, the following temperatures are found on the temperature sensors.

| Probes N° | 1, 2 | 3 to 6 | 7 | 8 to 12 | 13 to 20 | 21 to 23 | 24, 25 |
|---|---|---|---|---|---|---|---|
| Temp. (°C.) | 0 | +7 | +4 | +7 | +4 | +2 | +6 |
| Associated probes N° | 1 to 4 | 5 to 12 | 13, 14 | 15 to 24 | 25 to 24 | 41 to 46 | 47 to 50 |

Thenceforth, the probes are supplied with methanol at different temperatures in the following manner:

| probes N° | 1 to 4 | 5 to 12 | 13, 14 | 15 to 24 | 25 to 40 | 41 to 46 | 47 to 50 |
|---|---|---|---|---|---|---|---|
| Methanol temp. (°C.) | −55 | −80 | −70 | −80 | −70 | −55 | −80 |
| Exchangers used | E1 | E2 & E3 | E4 & E5 | E2 & E3 | E4 & E5 | E1 | E2 & E3 |

The foregoing remarks concerning the use of the exchangers, alone or in parallel, still apply in this example.

EXAMPLE IV

Note that it is quite possible to combine the various regulating processes described hereinbefore, and in particular to vary the temperature of injection of the methanol with respect both to time and to space. In this case, after having fixed the various temperatures of injection of the methanol into the various groups of probes, there is defined for each group a series of increasingly warm steps arranged within the total duration of the congelation so as to supply methanol at the end of the congelation to all the probes at the single set temperature which will be maintained throughout the period during which the wall is maintained in the congealed state.

The following example thus combines the teachings of the foregoing Examples I and III and describes in table form the congelation procedure during the allowed 100 hours for obtaining a wall having a thickness of 1 meter.

| N° of probes | time (h) 0 | 20 | 40 | 60 | 80 | 100 |
|---|---|---|---|---|---|---|
| 5 to 12<br>15 to 24<br>47 to 50 | −80° C. to all the probes with the exchangers E1 to E5 | −80° C. with E2 and E3 | −65° C. with E2 and E3 | −50° C. with E2 E3 E4 and E5 | −40° C. to all the probes with E1 to E5 | −35° C. to all the probes with E1 to E5 |
| 13 & 14<br>25 to 40 | | −70° C. with E4 & E5 | −60° C. with E4 & E5 | | | |
| 1 to 4<br>41 to 46 | | −55° C. with E1 | −50° C. with E1 | −40° C. with E1 | | |

What is claimed is:

1. A process for the congelation of ground, comprising cooling a refrigerant liquid by indirect heat exchange with a cryogenic fluid, then circulating said liquid in a plurality of probes driven into the ground, and progressively increasing the temperature of the liquid in the course of ground congelation as a function of the progression of the congelation.

2. A process according to claim 1, wherein the temperature of the liquid circulating in at least one of the probes is progressively increased in a plurality of successive steps.

3. A process according to claim 1, comprising supplying a refrigerant liquid to each probe at substantially the same flow.

4. An installation for the congelation of ground, comprising heat exchangers, means for supplying a cryogenic fluid to the heat exchangers, means for supplying a refrigerant liquid to the heat exchangers in indirect heat exchange with said cryogenic fluid, a plurality of congelation probes for insertion into the ground, means for circulating said refrigerant liquid in each probe, there being at least two independent said heat exchangers having different set temperatures, and means for selectively connecting at least one said probe to any one of said at least two independent heat exchangers, thereby selectively to vary the temperature of the refrigerant liquid circulating in said at least one probe.

5. An installation according to claim 4, wherein each heat exchanger comprises means for varying its set temperature.

6. An installation according to claim 4, wherein each probe comprises means for measuring temperature at different levels of an outer wall of the probe.

7. An installation according to claim 4, wherein said series of probes are arranged in a line and said installation further comprises a series of temperature sensors arranged in a line parallel to said line of probes, each temperature sensor being at an equal distance from two probes.

8. A process for the congelation of ground, comprising cooling a refrigerant liquid by indirect heat exchange with a cryogenic fluid, then circulating said liquid in a plurality of probes driven into the ground and varying the temperature of the liquid circulating in each said probe relative to the temperature of the liquid circulating in the other said probes such that said temperature varies directly as the rate of congelation of the ground adjacent each said probe.

9. A process according to claim 8, comprising for the purpose of determining the rate of congelation around each probe, measuring the diffence of temperature between the liquid entering the probe and the liquid leaving the probe.

10. A process according to claim 8, comprising measuring at the beginning of the cooling the rate of cooling the ground at a plurality of levels of each probe, and taking as said rate of congelation the lowest of said rates of cooling.

11. A process according to claim 8, comprising, for the purpose of determining the rate of congelation around each probe, temporarily injecting into each probe, some time after the beginning of the congelation, a liquid which is warmer than the ground in the vicinity of the probe, measuring the rate of rise in temperature at different levels of the probe, and taking as said rate of congelation rates of the rise in temperature at different levels of the probe.

12. A process according to claim 11, comprising measuring, for determining the rate of congelation around each probe, the temperature of the ground at a predetermined distance from all the probes.

13. A process according to claim 8, comprising supplying a refrigerant liquid to each probe at substantially the same rate of flow.

14. A process according to claim 8, and progressively increasing the temperature of the liquid circulating in at least one of the probes.

* * * * *